US005501483A

United States Patent [19]

Stepanek et al.

[11] Patent Number: 5,501,483

[45] Date of Patent: Mar. 26, 1996

[54] AUTOMATIC RELEASE SKI BINDING

[75] Inventors: Premek Stepanek, Garmisch-Partenkirchen; Gerd Klubitschko, Oberammergau; Werner Messerschmidt, Garmisch-Partenkirchen, all of Germany

[73] Assignee: Marker Deutschland GmbH, Germany

[21] Appl. No.: 152,576

[22] Filed: Nov. 15, 1993

[30] Foreign Application Priority Data

Nov. 16, 1992 [DE] Germany ..... 42 38 657.8

[51] Int. Cl.[6] ..... A63C 9/085

[52] U.S. Cl. ..... 280/625; 280/628; 280/631

[58] Field of Search ..... 280/626, 628, 280/629, 630, 631, 632, 625

[56] References Cited

U.S. PATENT DOCUMENTS

| | | | |
|---|---|---|---|
| 3,455,570 | 7/1969 | Salomon | 280/11.35 |
| 3,604,720 | 9/1971 | Reuge et al. | 280/11.35 |
| 3,617,069 | 11/1971 | Salomon | 280/632 |
| 3,638,959 | 2/1972 | Reuge | 280/11.35 T |
| 4,592,569 | 6/1986 | Nowak et al. | 280/624 |
| 4,756,545 | 7/1988 | Freisinger et al. | 280/618 |
| 4,867,471 | 9/1989 | Stritzl et al. | 280/618 |
| 5,028,069 | 7/1991 | Janisch et al. | 280/629 X |
| 5,044,658 | 9/1991 | Challande et al. | 280/631 |
| 5,050,903 | 9/1991 | Stritzl et al. | 280/629 X |
| 5,056,810 | 10/1991 | Rigal | 280/625 |
| 5,388,851 | 2/1995 | Challande et al. | 280/625 |

FOREIGN PATENT DOCUMENTS

| | | |
|---|---|---|
| 0228524A1 | 7/1987 | European Pat. Off. . |
| 0271694B1 | 6/1988 | European Pat. Off. . |
| 0300143A2 | 1/1989 | European Pat. Off. . |
| 0407707A2 | 1/1991 | European Pat. Off. . |
| 2640516A1 | 6/1990 | France . |
| 2662612A1 | 12/1991 | France . |
| 1937501.0 | 2/1971 | Germany . |
| 8900827.8 | 5/1989 | Germany . |
| 474278 | 8/1969 | Switzerland . |

*Primary Examiner*—Brian L. Johnson
*Assistant Examiner*—Michael Mar
*Attorney, Agent, or Firm*—D. Peter Hochberg; Mark Kusner; Michael Jaffe

[57] ABSTRACT

The invention relates to a toe piece for an automatic release ski binding. The toe piece is comprised of an upper housing and a base plate which is connected at one end with the upper housing. The upper housing and the base plate are additionally connected by at least one connecting element. In order to allow automatic adjustment of the sole holder to different heights and a reverse release, at least one end of the at least one connecting element is journaled either in the upper housing and/or in the base plate, with the intermediate placement of a resilient material. Alternatively, the connecting element itself is constructed of resilient material.

16 Claims, 4 Drawing Sheets

AUTOMATIC RELEASE SKI BINDING

FIELD OF INVENTION

The present invention relates generally to a ski binding. More particularly, the present invention relates to a ski binding having an automatic release.

BACKGROUND OF INVENTION

European patent application 0 300 143 A2 discloses an automatic release ski binding having a housing accommodating a release spring and a sole holder. The sole holder is arranged on a bolt extending substantially perpendicular to the top side of a ski. This bolt has its lower end journaled in a support body arranged separately in the housing. The sole holder runs in a sliding fashion on the bolt and is acted upon by a compression spring urging it against the top side of the boot sole. It is in this manner that the sole holder is lifted within a certain tolerance limit if, for example, there is snow underneath the sole of the boot.

Similar sole holders are disclosed in the German patent publication 8,900,827 U and the French patent publication 2,662,612 A1.

European patent publication 0 228 524 A1 and European patent publication 0 271 694 B1 disclose other ski binding designs. In these designs the lateral jaws of the sole holder are not journaled on the previously mentioned bolts, which join the base plate and the upper part of the housing. In this respect, the lateral jaws are pivoted on pivot pins of an articulated quadrilateral, which consists of two levers arranged laterally in the housing, and a link connecting the two levers together.

SUMMARY OF INVENTION

One object of the present invention is to provide a ski binding having an automatic yet simple adjustment in the height of the sole holder, even where the ski binding has a sole holder not directly journaled on a connecting bolt.

A further object of the present invention is to provide a ski binding which allows a predetermined, regular reverse release.

The preferred form of present invention achieves its objectives by means of at least one connecting means and a resilient means. At least one end of the connecting means, preferably in the form of a bolt, is journaled, with the intermediate arrangement of a resilient means, either in the upper part of the housing and/or in the base plate. Alternatively, the connecting means itself can be made resilient between the upper part of the housing and the base plate. In this case, advantage is taken of the fact that the upper part of the housing is connected at one end with the base plate. The material of the housing is preferably elastic, and the free ends of the upper part of the housing and of the base plate are able to be pivoted in relation to each other to a certain degree. The bolt(s), arranged adjacent to the freely pivoting end of the upper part of the housing, and serving for connection of the upper part of the housing with the base plate, limits the pivoting movement thereof in an upward direction, with the result that overloading of the entire housing is prevented at the joint between the upper part of the housing and the base plate. Owing to the intermediate arrangement of the resilient means, which has a suitable, predetermined resilient characteristic, it is possible for the resilient property of the housing to be employed for automatic adaption in height of the sole holder to suit the sole of the boot.

In one embodiment of the present invention, the base plate and the upper part of the housing are integral. For example, they may consist of an integral synthetic resin injection molding. In an alternative embodiment of the present invention, the base plate and the upper part of the housing are formed of two individual parts. For example, they may be joined together by means of screws, thus permitting the distance between the base plate and the upper part of the housing to be adjusted by means of at least one set screw. Accordingly, a coarse adjustment may be performed as regards the pivoting displacement of the upper part of the housing.

In a preferred embodiment of the present invention, the resilient means comprises a disk of elastomer.

In the present invention a boot sole may bear directly against the upper part of the housing when urged in the upward direction. It is possible for the boot sole to be not only located laterally in the sole holder but also in the upward direction.

The present invention allows the resilient means to be compressed to such an extent that the sole holder releases the boot for movement in an upward direction if the pivot path of the upper part of the housing is limited, as by the bolt head. It is then possible to cause a predetermined reverse release of the sole of the boot in a particularly simple fashion, if for instance there is a front jaw.

Furthermore, the preloading action of the resilient means may be adjustable so that the pivot path of the upper part of the housing in relation to the base plate may be modified.

The sole holder may in a known fashion be acted upon by the force of a release spring. In this respect, reference should be had to European patent publication 0 228 524 A1 or European patent publication 0 271 694 B1. It is advantageous to couple the adjustability of the preloading action of the resilient means with the adjustability of the force of such release spring. In this respect, it is possible for the lateral release force of the sole holder to be able to be so affected to reduce the degree of vertical motion of the upper part of the housing.

In accordance with a preferred embodiment of the invention, the base plate and the upper part of the housing are connected with one another by two bolts, such bolts being pivoted or journaled in blind holes provided in the upper part of the housing.

Also in accordance with a preferred embodiment of the invention, the sole holder is pivoted on an articulated quadrilateral, which is pivotally mounted by means of two levers for pivoting motion about bolts which are set in the upper part of the housing. This ensures that the sole holder is able to be pivoted with the articulated quadrilateral and furthermore with the upper part of the housing in relation to the base plate.

Further advantageous developments and convenient forms of the invention will be explained with reference to a preferred embodiment illustrated in the drawing. The two figures each show a partly sectioned side elevation of a preferred embodiment of the invention.

DETAILED DESCRIPTION

Figure 1:
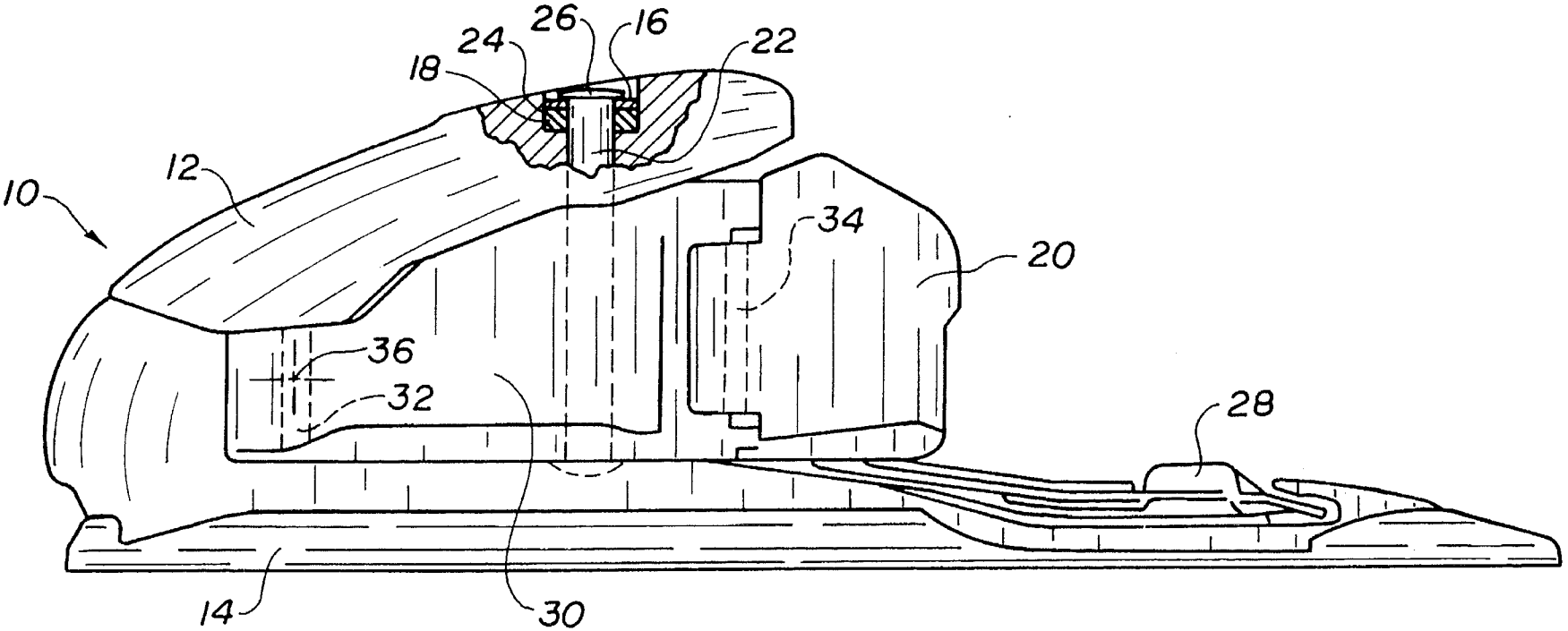
FIG. 1 is a side view of a ski binding illustrating a preferred embodiment of the present invention.

Referring now to FIG. 1, the front jaw 10 comprises a housing, which is comprised of a base plate 14 that is secured to a ski, and an upper part 12 of the housing that is held onto the base plate. As shown in FIG. 1, base plate 14 extends to the right past the upper part 12 of the housing and at its free end forms a claw for holding the free end of a pivoting tread plate 28, which may be of known design and to which the invention does not specifically relate.

An articulated quadrilateral with levers 30 is arranged together with a link 40 between the base plate 14 and the upper part 12 of the housing, by means of two bolts 32 extending perpendicularly to the plane of the ski. The link 40 functions in a well known manner as a support member for two lateral jaws, which are each respectively journaled on one of the pivot pins 34 of the link against the lever 30. The lateral jaws are part of the sole holder 20. While the manner of operation of the articulated quadrilateral is disclosed, for example, in European patent publication 0 228 524 A1 or in European patent publication 0 271 694 B1 the present invention does not specifically relate to the articulated quadrilateral.

Upper part 12 of the housing is connected with base plate 14 by means of one or preferably two bolts 22, which are adjacent to the free end of the upper part 12 of the housing. In the upper part 12 of the housing, blind holes 24 are provided in order to accommodate resilient means 18, which are preferably in the form of elastomer disks. The head 26 of the bolts 22 bears upon the resilient means 18. Preferably, a metallic washer 16 extends over the full area of the blind hole between the bolt head 26 and the resilient means 18, in order to provide for improved transfer of the force from the bolt head to the resilient means 18. In accordance with this arrangement, the upper part 12 of the housing, together with the base plate 14, comprise a housing, which has a degree of freedom of movement generally perpendicular in relation to the base plate 14.

The ski binding of the present invention is adapted to suit the height of a boot sole by using the sole holder 20 and the levers 30, which bear against the upper part 12 of the housing and urge the upper part 12 upwards, against the resilient preloading action of the housing and against the force of the resilient means 18. The upper part 12 of the housing pivots about the virtual axis 36 of rotation near the bolts 32.

Figure 2:
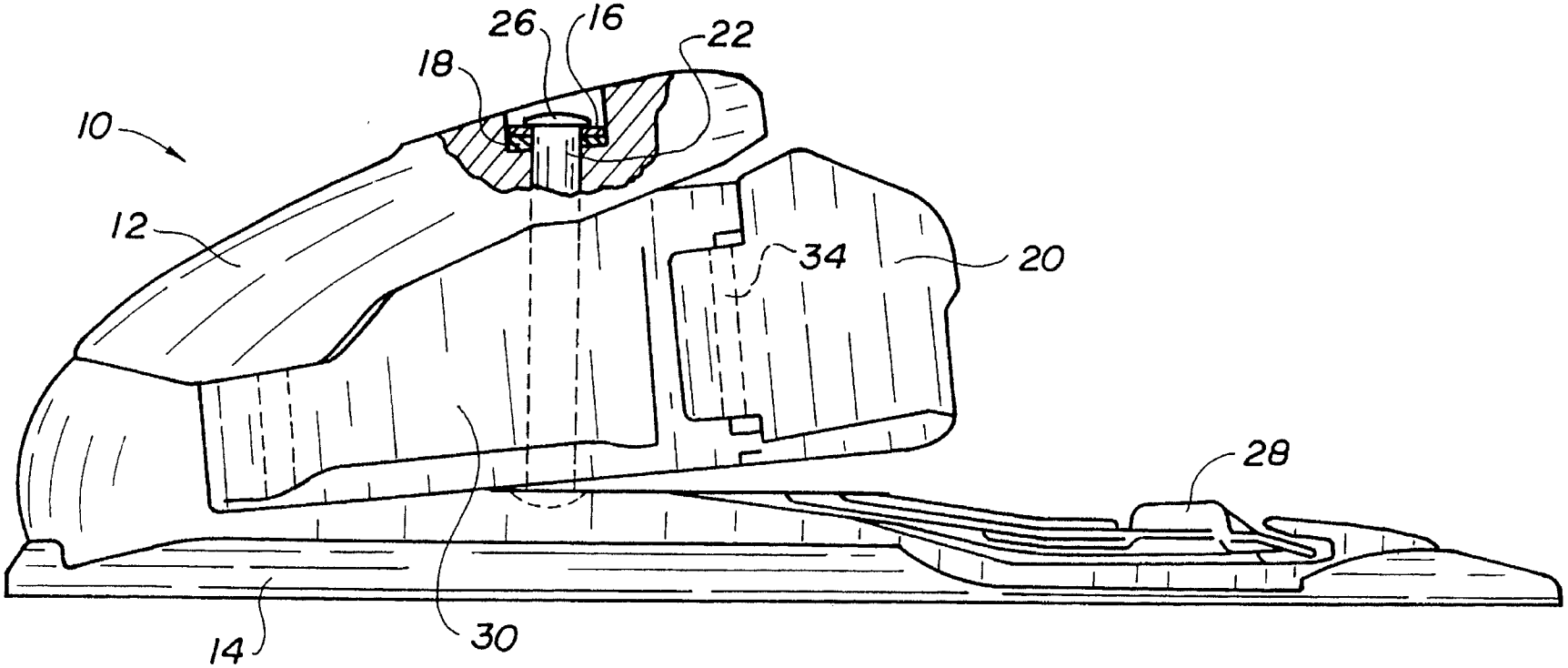
FIG. 2 is a side view of the ski binding shown in FIG. 1 in a reverse release condition.

Referring now to FIG. 2, a reverse release action will be described. A reverse release action occurs when the sole holder 20 is displaced so far that the boot sole (not shown) comes free from the ski binding. Bolts 32 are held stationary in the upper part 12 of the housing and are pivoted together with the upper part 12 of the housing. The ends of the bolts 32 adjacent to the base plate 14 run respectively in a slot, to allow the pivoting of the bolts 32 together with the upper part 12 of the housing. Alternatively, it is possible for the bolts 32 to terminate above the base plate 14 so that they are not prevented by the base plate 14 from pivoting. While other similar working embodiments are possible, it is important that the bolts 32 be so journaled that the levers 30 and the sole holder 20 are not prevented from taking part in the pivoting motion of the upper part 12 of the housing.

The bolts 22 are journaled in the base plate 14 such that their longitudinal axis is able to move, so that the bolts do not obstruct the pivoting motion of the upper part 12 of the housing in relation to the base plate 14.

Figure 3:
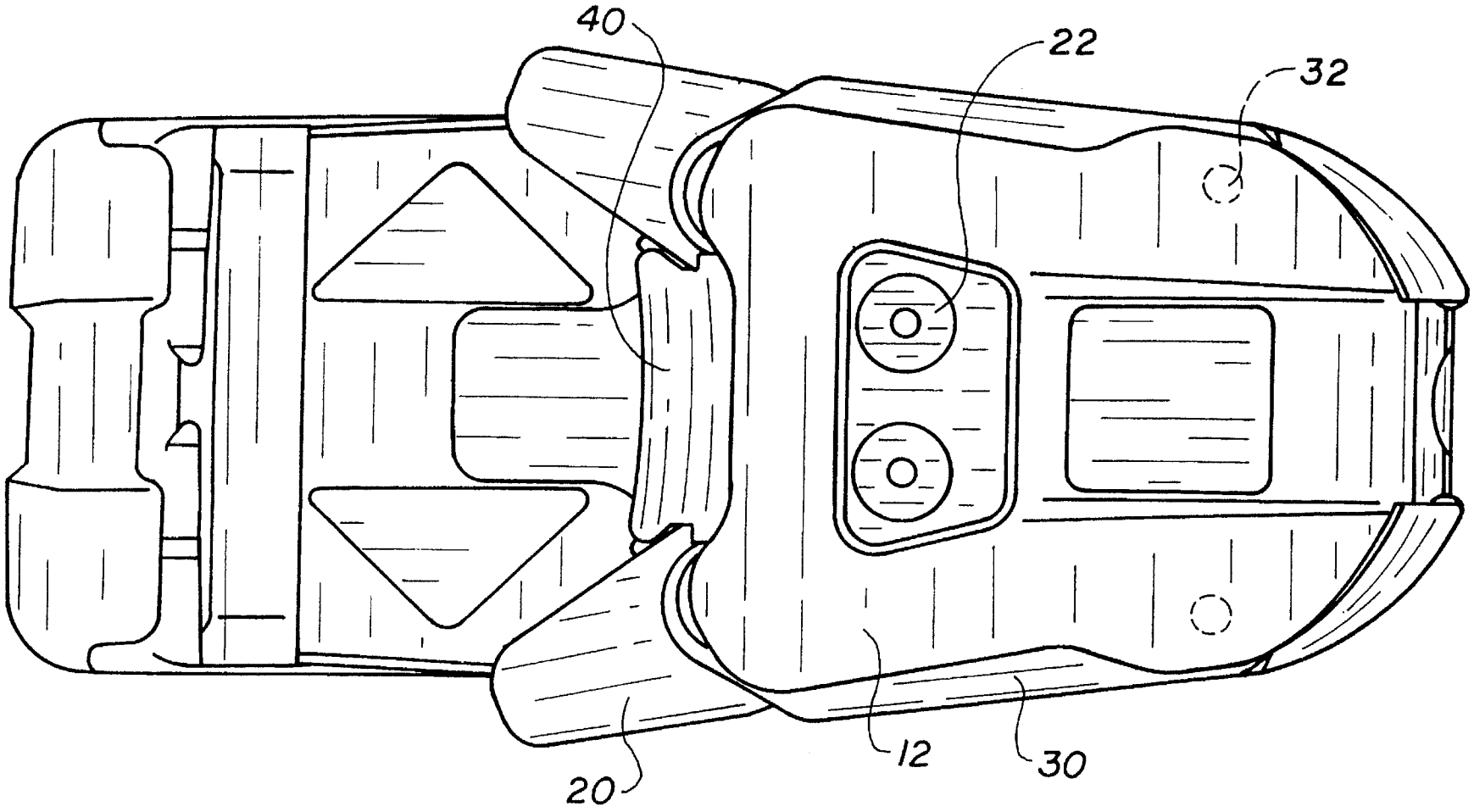
FIG. 3 is a top plan view of the ski binding shown in FIG. 1.

A top plan view of a preferred embodiment of the present invention is shown in FIG. 3. Accordingly, FIG. 3 shows sole holders 20 mounted on the articulated quadrilateral, with levers 30 mounted for motion about bolts 32 secured in upper part 12 of the housing. Also shown is the position of bolts 22 and bolts 32 relative to the longitudinal axis of the ski binding.

Figure 4:
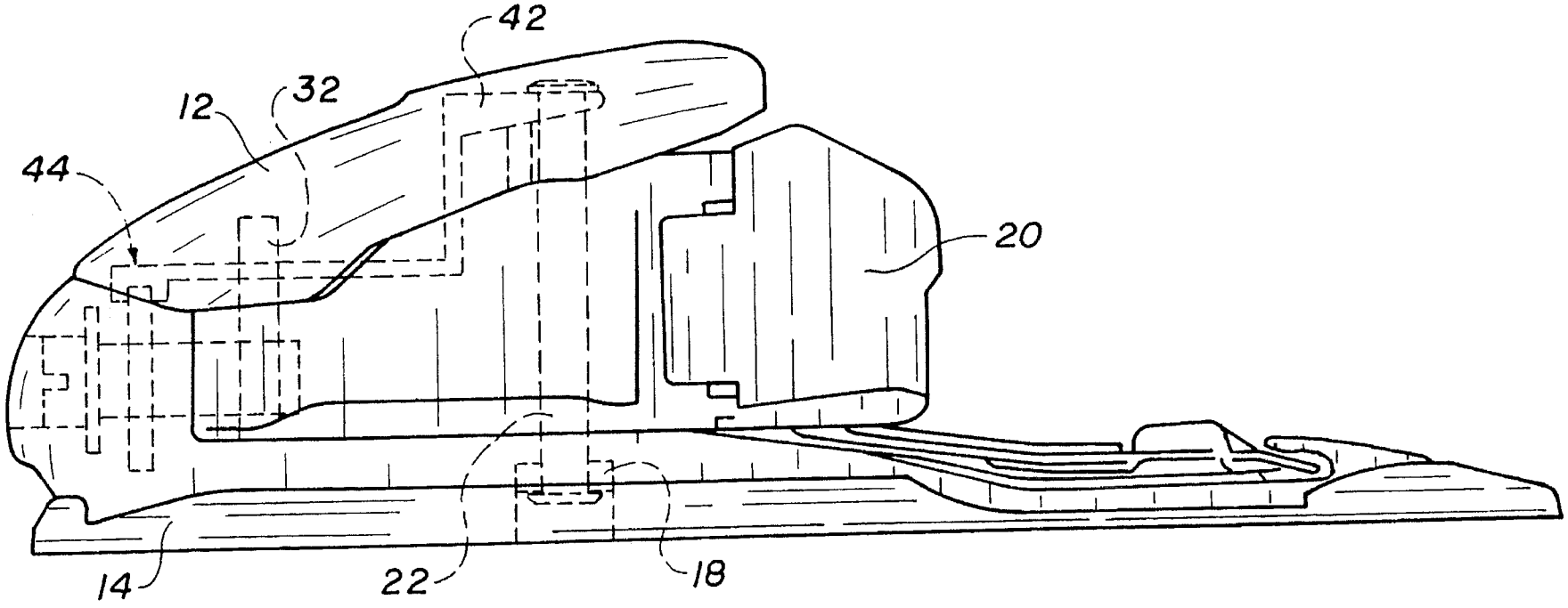
FIG. 4 is a side view of a ski binding illustrating an alternative embodiment of the present invention.

Referring now to FIG. 4, an alternative embodiment of the present invention is shown. The upper part 12 of the housing is integrated with the base plate 14. The resilient means 18 is located in the base plate 14 to absorb rotational forces applied to the upper part 12 of the housing. An adjusting means 42 is provided in the upper part 12 of the housing to adjust the preloading action of the resilient means 18. The adjusting means 42 urges upward the end portion of bolt 22 in the upper portion 12 of the housing. Consequently, the forces acting upon the resilient means 18 increase as the adjusting means 42 urges the end portion of bolt 22 upward. A coupling means 44 is provided to couple the adjusting means 42 to the release spring of the sole holder. As the tension of the release spring is increased, the adjusting means 42 urges the end portion of bolt 22 upward, thus increasing the preloading forces acting upon the resilient means 18.

The invention has been described in sufficient detail to enable one skilled in the art to practice the invention, but variations and modifications within the spirit and scope of the invention may occur to those skilled in the art to which the invention pertains.

We claim:

1. A ski binding for securing a ski boot to a ski, said ski binding comprising:

a base member fixable to said ski, said base member having a longitudinal axis;

an upper housing portion rotatable at one end about an axis transverse to the longitudinal axis of the base member;

sole holder means connected to said upper housing portion at an opposite end and including a pair of jaws for laterally holding the sole of the ski boot, said sole holder means rotatable about said transverse axis with said upper housing portion;

generally vertical connecting means for connecting said upper housing portion with said base member, said upper housing portion movable along said vertical connecting means when rotating about said transverse axis; and resilient means operatively engageable with said connecting means, for absorbing a rotational force applied to said upper housing portion when said upper housing portion rotates about said transverse axis and for biasing said upper housing portion towards said base member.

2. The invention as defined in claim 1, wherein said upper housing portion includes receptacle means for receiving said connecting means and said resilient means.

3. The invention as defined in claim 2, wherein said connecting means comprises at least one bolt having a head portion and a threaded portion.

4. The invention as defined in claim 3, wherein said resilient means comprises at least one resilient disk having an upper surface engageable with said head portion.

5. The invention as defined in claim 4 wherein said resilient disk is an elastomer disk.

6. The invention as defined in claim 4, wherein said bolt extends through said resilient disk and said receptacle means; said head portion being engageable with the upper surface of said disk and the threaded portion being engageable with said base member.

7. The invention as defined in claim 3, wherein said head portion engages said resilient means to limit the rotation of said upper housing about the transverse axis.

8. The invention as defined in claim 3, wherein said receptacle means comprises a coaxial larger diameter blind hole to receive the at least one resilient disk.

9. The invention as defined in claim 1, wherein said upper housing and base plate are integral.

10. The invention as defined in claim 1, wherein said resilient means is compressed to release a ski boot in an upward direction.

11. The invention as defined in claim 1, wherein said toe piece further comprises an adjusting means for adjusting a preloading force acting on said resilient means.

12. The invention as defined in claim 11, wherein said toe piece further comprises a release spring for biasing said sole holder means, wherein said adjusting means is coupled between said connecting means and the release spring, said preloading force increasing as the tension on the release spring is increased.

13. The invention as defined in claim 12, wherein said adjusting means urges said connecting means upward to increase the preloading forces acting on said resilient means.

14. The invention as defined in claim 1, wherein said connecting means comprises fastener means having a head portion, said resilient means engageable with said head portion of said fastener means.

15. The invention as defined in claim 14, wherein said resilient means is engageable with said upper housing portion.

16. The invention as defined in claim 14, wherein said resilient means is engageable with said base member.

* * * * *